US007621532B2

(12) United States Patent
Tippy

(10) Patent No.: US 7,621,532 B2
(45) Date of Patent: Nov. 24, 2009

(54) BOARD GAME

(76) Inventor: Gary Tippy, 9 Teal Dr., Langhorne, PA (US) 19047

( * ) Notice: Subject to any disclaimer, the term of this patent is extended or adjusted under 35 U.S.C. 154(b) by 0 days.

(21) Appl. No.: 11/558,512

(22) Filed: Nov. 10, 2006

(65) Prior Publication Data

US 2007/0063435 A1 Mar. 22, 2007

Related U.S. Application Data

(63) Continuation-in-part of application No. 11/378,715, filed on Mar. 17, 2006, now abandoned.

(60) Provisional application No. 60/663,183, filed on Mar. 17, 2005.

(51) Int. Cl.
*A63F 3/00* (2006.01)

(52) U.S. Cl. ..... 273/243; 273/236

(58) Field of Classification Search ..... 273/284, 273/243, 236

See application file for complete search history.

(56) References Cited

U.S. PATENT DOCUMENTS 1,518,306 A * 12/1924 Clegg ..... 273/248
3,033,572 A * 5/1962 Thibault ..... 273/243
3,170,696 A * 2/1965 Nielsen ..... 273/243
3,733,074 A * 5/1973 Daley ..... 273/238
4,682,777 A * 7/1987 Wood ..... 273/243
5,941,525 A * 8/1999 Gallub ..... 273/248
6,336,634 B1 * 1/2002 Stott ..... 273/287
2006/0061035 A1 * 3/2006 Collins et al. ..... 273/242

* cited by examiner

*Primary Examiner*—Vishu K Mendiratta
(74) *Attorney, Agent, or Firm*—Saul Ewing LLP

(57) ABSTRACT

The present invention is a strategy and/or educational board game in which 2-4 players distribute game pieces, e.g., marbles or other tokens, according to a particular sequence among a common field of play, with the object of the game being to be the first player to collect a predetermined number of game pieces in a "home" location. Each player is assigned a single home location for their exclusive use; the remainder of the field of play is commonly shared by all players. In a preferred embodiment, a spinner is spun by each player, with the spinner stopping and pointing at a number or graphic. The player must locate the same number or graphic on the field of play to identify the starting point for a move. Once the number or graphic is located, game pieces sitting in a well associated with the number or graphic are picked up by the player, and the player chooses movement in either a clockwise or counter-clockwise direction. The user then distributes the game pieces, one-by-one, in each well encountered in the selected direction. The game pieces are not associated with any player, that is, all of the same pieces are usable by all of the players when the pieces are in play.

1 Claim, 9 Drawing Sheets

BOARD GAME

CROSS-REFERENCE TO RELATED APPLICATIONS

This application is a continuation-in-part of U.S. application Ser. No. 11/378,715, filed Mar. 17, 2006, which is based on and claims priority to U.S. Provisional Application No. 60/663,183, filed Mar. 17, 2005, the contents of which is fully incorporated herein by reference.

BACKGROUND OF THE INVENTION

1. Field of the Invention

This invention relates to strategic and/or educational games and, more particularly, to strategic and/or educational games played on a board around which tokens are placed and moves are directed by players based on the use designating device such as a spinner.

2. Description of the Related Art

There are large numbers of strategic and/or educational board games on the market today. Each game offers its own unique strategies and/or teaches users certain things in a unique way. One example of a known board game is found in U.S. Pat. No. 3,170,696 to Nielsen. In the game of Nielsen, each player has an assigned row (e.g., in a four-person version there are four parallel rows, each of a different color, with each player being assigned a different row/color), and the player uses his or her assigned row as his or her field of play during the game. Chips are moved around the field of play, with movement of chips by a particular player being restricted to their own field of play. The game ends when one of the players has moved their chips in such a manner that they have filled their "home bonus member" with chips.

It is an object of the present invention to improve upon existing strategy and/or educational games by creating a strategy/educational board game with a unique field of play and set of rules that improves counting skills, matching skills, and strategic thinking skills.

SUMMARY OF THE INVENTION

The present invention is a strategy and/or educational board game in which 2-4 players distribute game pieces, e.g., marbles or other tokens, according to a particular sequence among a common field of play, with the object of the game being to be the first player to collect a predetermined number of game pieces in a "home" location. Each player is assigned a single home location for their exclusive use; the remainder of the field of play is commonly shared by all players and comprises a plurality of pathway locations between the home locations. In a preferred embodiment, a move designator, e.g., a spinner, is activated by each player, with the designator identifying a particular number or graphic. The player must locate the same number or graphic on the field of play to identify the starting point for a move. Once the number or graphic is located, game pieces sitting in a well associated with the number or graphic are picked up by the player, and the player chooses movement in either a clockwise or counter-clockwise direction. The user then distributes the game pieces, one-by-one, in each well encountered in the selected direction. The game pieces are not associated with any player, that is, all of the same pieces are usable by all of the players when the pieces are in play.

DETAILED DESCRIPTION OF THE PREFERRED EMBODIMENTS

Figure 1:
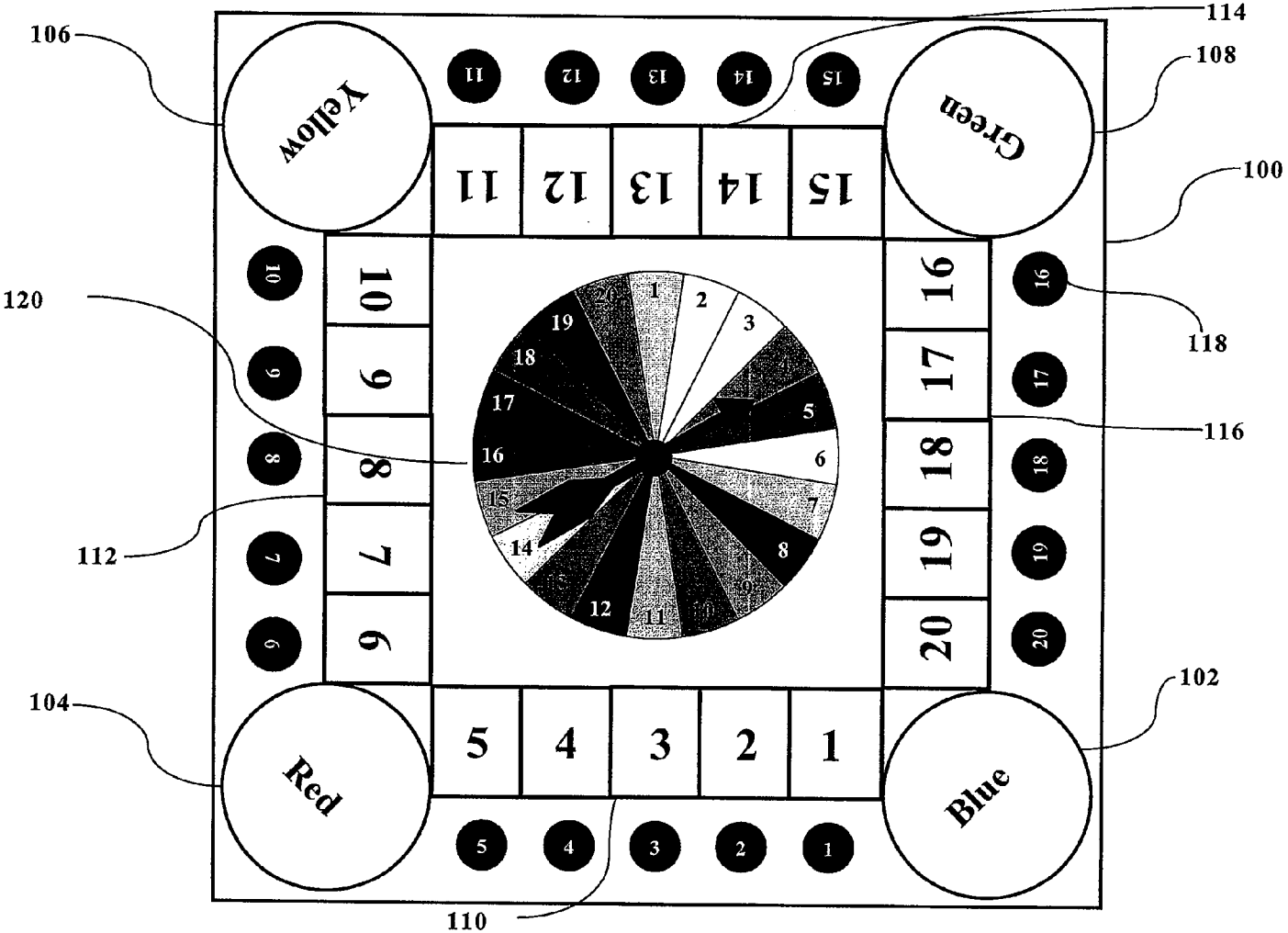
FIG. 1 is a top view of an example of a game board in accordance with the present invention.

FIG. 1 is a top view of an example of a game board in accordance with the present invention. Referring to FIG. 1, a game board 100 includes four home corner-wells 102, 104, 106, and 108. Situated between the home corner wells are pathways 110, 112, 114, and 116, which in combination form a single common field of play for use by all players during the course of a game. In a preferred embodiment, the pathways comprise twenty pathway wells, five per pathway, as shown. In this example, the pathway wells are given sequential designations, e.g., numbers, which are visible to the players, e.g., pathway wells 1-5 make up pathway 110, pathway wells 6-10 make up pathway 112, pathway wells 11-15 make up pathway 114, and pathway wells 16-20 make up pathway 116. Similarly, the home corner-wells 102, 104, 106, and 108 are given unique designations visible to the players, e.g., colors in this example. Thus, in the example of FIG. 1, home corner-well 102 is colored blue, home corner-well 104 is colored red, home corner-well 106 is colored yellow, and home corner-well 108 is colored green.

In a preferred embodiment the home corner-wells and pathway wells are constructed to have walls so that game pieces, e.g., marbles, can be placed in them and be contained within the wells. As described in more detail below, during play the pathway wells may be filled with tokens to a point where the designations marked inside the wells are obstructed; accordingly, in a preferred embodiment, graphic aids corresponding to the pathway well designations (see graphic aid 118, typical) are provided outside of the pathways to assist players in locating particular pathway wells during game play.

A spinner 120 is situated at the center of board 100. Spinner 120 provides a mechanism to direct the actions of players during game play, as described in more detail below. Spinner 120 is a standard spinning device commonly found in board games and includes a spin designator that is spinnable by a player to cause it to spin about a center axis. The spin designator is centered within a spinner dial in a well-known manner. The spinner dial is divided into a number of sections equal to the number of pathway wells being used in the game; in the example of FIG. 1 there are 20 sections as shown, one each corresponding to one of the pathway wells. It is understood that although a spinner is the preferred way of designating moves, other designation methods, e.g., dice, electronic selection devices, etc., may be used and still fall within the scope of the claimed invention.

Figure 2A:
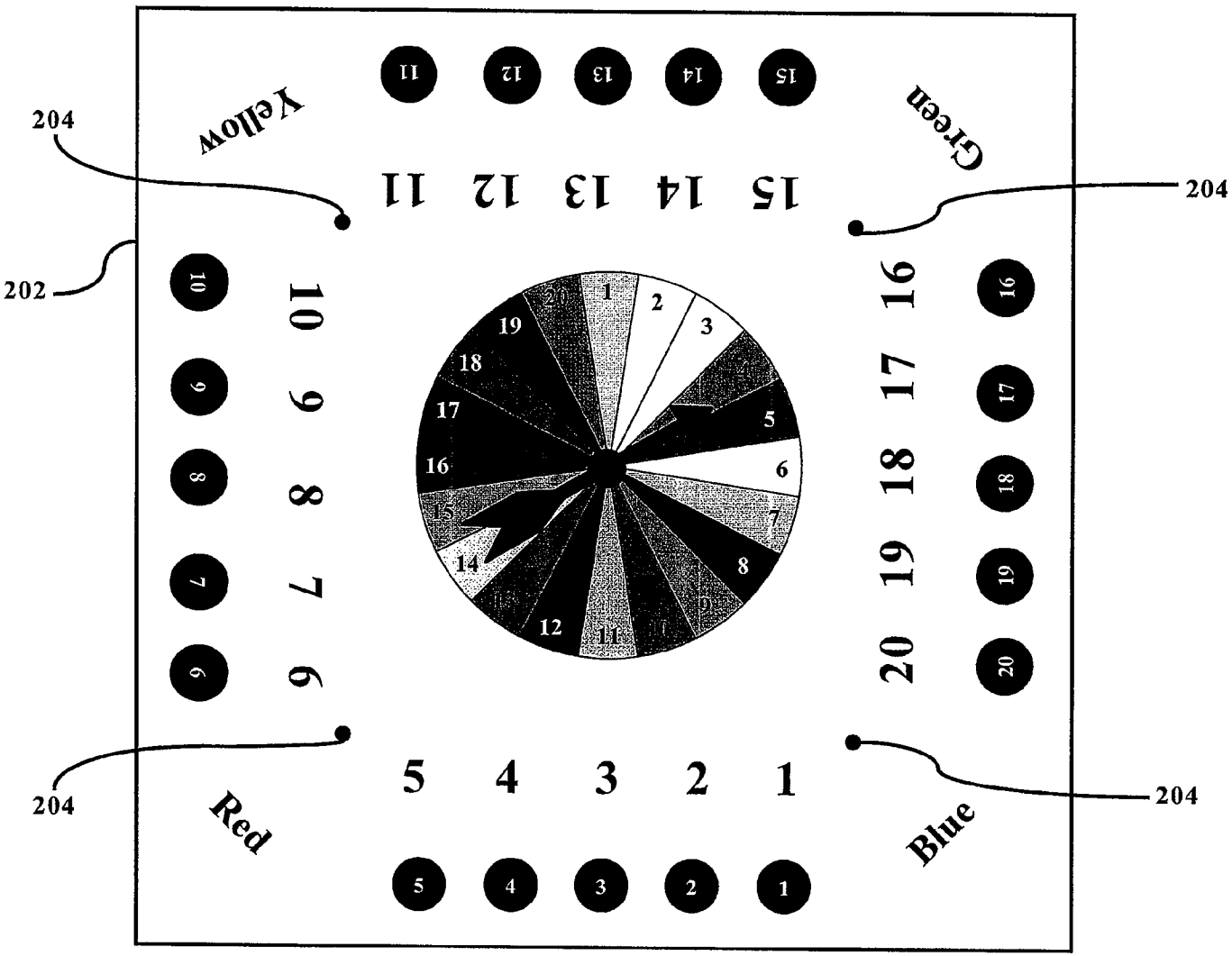
FIG. 2*a* illustrates the game base used in connection with the game illustrated in FIG. 1.
Figure 2B:
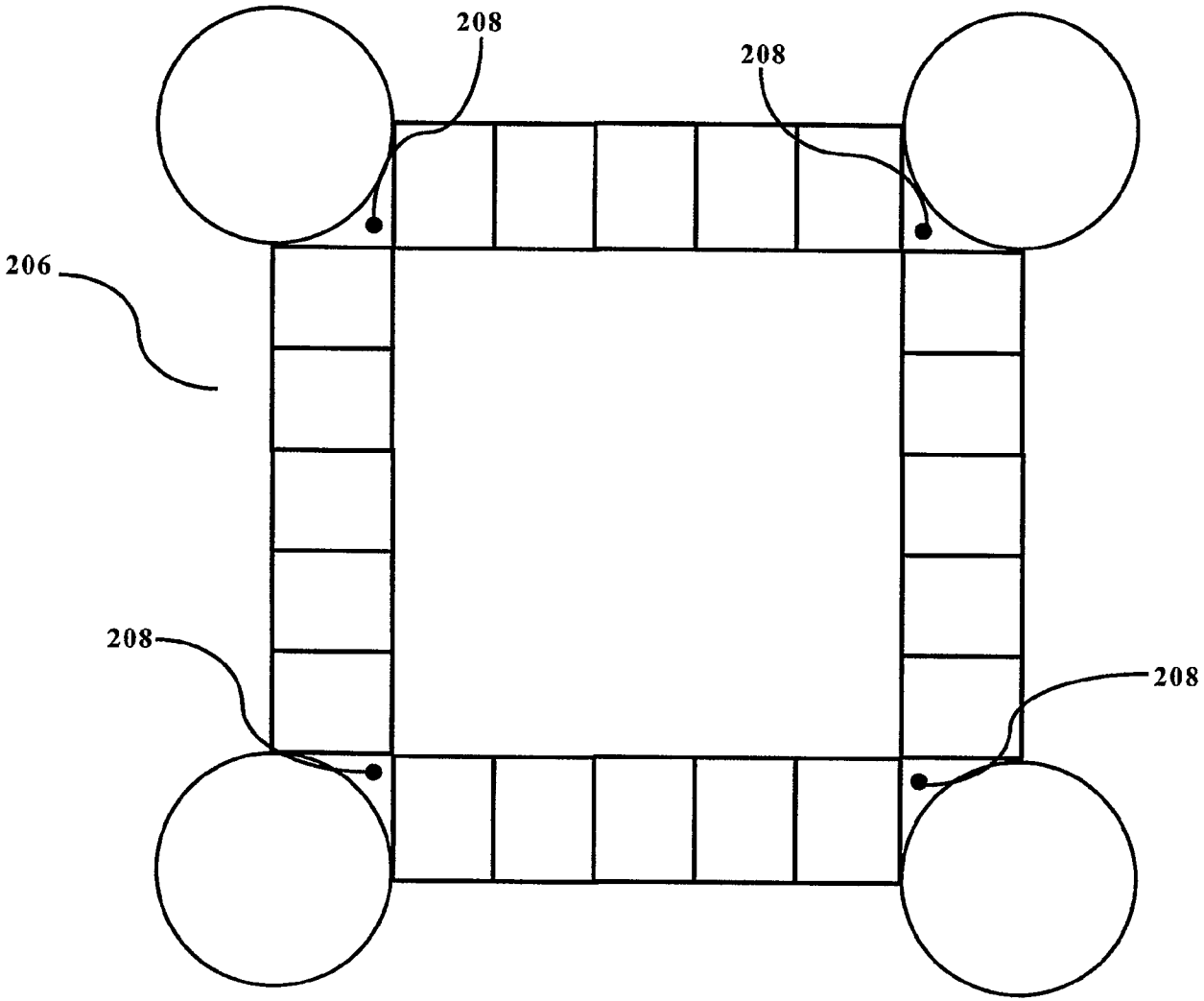
FIG. 2*b* illustrates the game top in more detail.
Figure 2C:
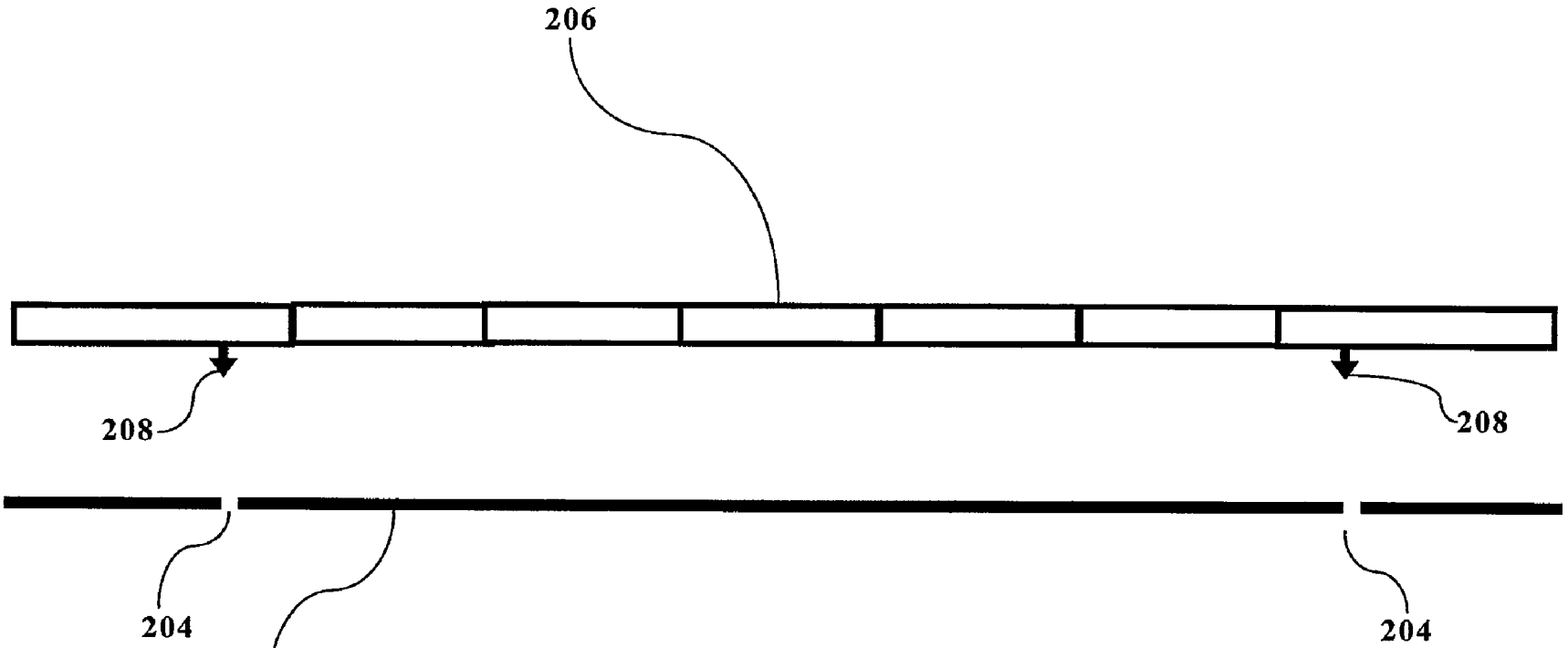
FIG. 2*c* illustrates the mounting pegs which extend downward from the game top.

The game board described above and shown in FIG. 1 illustrates an example of one graphical configuration that can be used for the game of the present invention. By constructing the game board as a two piece structure as illustrated in FIGS. 2*a*-2*c*, an unlimited number of graphical configurations are available, so that instead of using numbers as the designations in the pathway wells, images, shapes, letters, phonetic teaching aids, photographs, etc., and combinations thereof, may be utilized to allow for variations. This allows the game to be customized to meet the interests of the players, so that, for example, a game with a sports theme could be played, and then another theme, e.g., animals, could be utilized for a subsequent game.

Referring to FIGS. 2*a*-2*c*, a game base 202 contains the graphics that will be used during game play. Preferably the game base 202 is constructed of cardboard or other flexible, durable and inexpensive material, since there will be many different graphical game bases used and thus having them be inexpensive is preferred. The game base used in connection with the game illustrated in FIG. 1 is shown in FIG. 2*a*. As can be seen, the graphic images of the game board 100 of FIG. 1 appear on game base 202 (e.g., the number designations in the pathway wells, the color designations for the home corner-wells, the graphic aids 118, the spinner dial, etc.). Holes 204 are punched through game base 202 at locations that correspond to the locations of mounting pegs 208 that are integral with game top 206, both of which are described in more detail below.

Alternative gameboards can also be used. For example, another design option for the game base 202 can be an electronic graphic game board base. This electronic graphic game board base can contain multiple graphic game board designs in one electronic game board base. Any known technology (e.g., LED, LCD, etc.) can be used for the electronic graphic game board base and it can be programmed using well-known programming techniques to display various images depending upon the discretion of the designer. Alternatively, the game base 202 can be a reversible graphic game board base, whereby one side of the game base will have a first set of graphic designs used to play the game, and when the base is flipped, the opposite side will have a second, different set of graphic designs to play the game.

Another option for the graphic game board base 202 is described below and has particular applicability to educational purposes. This embodiment uses four different decks of question playing cards (example: Deck 1, Deck 2, Deck 3, and Deck 4), each card containing a question and an answer to the question (e.g., the question could be posed as "1+1=?" and the answer, printed on the opposite side of the card, would be "2"). The quantity, size, and content of the question playing cards will be determined by the designer. The answer to the playing question cards will match one of the twenty pathway playing wells located around the board. For example, in the example given above, the number "2" will be located in one of the 20 pathway playing wells. It is understood that numbers are given for the purpose of example only; any type of answer can be used and will fall within the scope of the present invention.

The center spinner dial in this multi-deck embodiment is broken up into 20 sections: five sections will be labeled Deck 1; five sections Deck 2; five sections Deck 3; and five sections Deck 4. When a player spins the spinner dial arrow will land on Deck 1, 2, 3, or 4. The player will pick up one playing question card from the deck that the spinner dial arrow has pointed to. That player will attempt to solve the questions and if the answer is correct, move onto the answer in the pathway playing wells and continue with the rules of play at that point. If the player answers the question incorrectly, their turn is over.

Game top 206 is shown in more detail in FIG. 2*b*. As can be seen in FIG. 2*b*, game top 206 defines the home corner-wells and pathway wells. Each pathway well is defined by a rectangular "box" having wells and open on the top. A clear plastic bottom can be provided for the bottom of the well; alternatively, the bottom can remain open, so that the game base performs the function of providing a well bottom. Each home corner-well is defined by a circular, walled area, also open on top. In a preferred embodiment, both the pathway wells and home corner-wells have plastic bottoms and game top 206 is constructed of clear plastic so that the graphic images on game base 202 are visible therethrough.

As described in the explanation of game play herein, the object of the game is to be the first player to have ten tokens placed in that player's home corner-well. In a preferred embodiment, the game tokens used are marbles. Further, in the preferred embodiment, the home corner-wells can have ten dimpled depressions distributed within the home corner-well so that, when marbles are placed in the home corner-well, the marbles will sit in the dimpled depressions without movement, making it easier to see how many are contained in the home corner-well and how many marbles are missing.

Game top 206 includes the previously-mentioned mounting pegs 208, which extend downward from the game top 206 as best seen in FIG. 2*c*. Mounting pegs 208 can be extruded plastic and can include a "spear-head" design to enable the game base 202 to be held in place when mated with game top 206 but still be removable due to the flexible nature of the material of which the game base 202 is constructed. It is understood that any means for mounting a base to a top can be used (e.g., Velcro, threaded pegs with matching nuts, magnets, forming a lip on the game top and a mating portion on the game bottom similar to the sealing mechanism for Tupperware®, etc.) and still fall within the scope of the present invention.

As can best be seen in FIG. 2*c*, the mounting pegs 208 align with holes 204 such that game base 202 can be placed on mounting pegs 208, thereby holding the game base in place and aligning the graphical images on game base 202 with the appropriate elements of game top 206. Because the game base 202 is easily removable and replaceable, different game bases 202, with different graphics, themes, etc. can be used to change the theme of the game.

The rules and object of the game will now be described. In a preferred embodiment, the game can be played with four, three, or two players, and there is no change to the game board design, set up, or rules of play for four, three, or two players. With appropriate modifications to the game board (e.g., adding additional "home" areas for each additional player), more than four players could play the game. The object of the game is to be the first player to collect ten tokens in their own home corner-well. If desired, once a first person has collected ten tokens to become the first-place winner, play can continue to determine second and third place winners; alternatively, the game can be terminated and a new game can then be started.

To set the game up five tokens are placed in every other pathway well, starting with any pathway well. In the example of FIGS. 1 and 2*a*-2*c*, since there are twenty pathway wells, 50 tokens are required. When setup is complete, there will be ten empty pathway wells and ten pathway wells each of which contain five tokens. All of the home corner-wells are empty at this point.

Each player selects one of the home corner-wells as their home well, and each player positions themselves next to their home well during the play of the game. Any one of the players then spins the spin designator, which must complete at least one full rotation. When the spin designator stops spinning, the arrow point of the spin designator will face a direction. The player whose home well is closest to the position to which the arrow points is the player who begins play. If the arrow point of the spinner points to a point exactly between two home corner-wells, a player spins the spin designator again, until a first player is selected. With respect to the players and their respective turns, play will proceed clockwise, beginning with the first player as selected by the spinning process.

To begin game play, the player selected to go first spins the spin designator, and it will stop on a particular position on the spinner dial, in this example, one of the numbers from 1-20. If the spin designator stops on a line between two positions on the spinner dial and it thus cannot be determined on which position it landed, the player spins again until the pointer arrow clearly lands on a discrete position on the spinner dial. The player then matches up the symbol (the number in this example) designated by the spin position and the corresponding symbol on a pathway well. For example, if the spinner stops on the number 4, then the player locates the pathway well bearing the graphic of the number 4.

If there are no tokens in the pathway well corresponding to the spin, the player's turn is over and play moves clockwise to the next player. However, if there are tokens in the pathway well corresponding to the spin, the player's turn continues, as follows. First, the player picks up all the tokens in that pathway well, and then they begin depositing tokens, one at a time, in the direction of the player's choice (clockwise or counterclockwise). The player deposits one token in each next pathway well, and if as they are depositing the tokens they encounter their own home corner-well, then they also deposit a token into their home corner-well. The home corner-wells of other players are skipped during this counting process. The player continues depositing the tokens in the selected direction until all of the tokens have been deposited. If the last token deposited by a player during his or her turn is deposited into his or her home corner-well, the player's turn is over and play moves to the next player. Similarly, when a player deposits his or her last token in an empty pathway well, their turn is over. However, when a player deposits the last token into a pathway well containing at least one token, the play continues. Specifically, the player picks up all of the tokens in that last pathway well and continues depositing tokens, one by one, in subsequent pathway wells and/or their own home corner-well, moving in the same direction as initially selected. This process continues until the player deposits his or her last token into an empty pathway well or into their own home corner-well.

Player 2 (and all subsequent players) execute the game play in exactly the same manner, that is, by spinning the spin designator, and if there are any tokens in the designated pathway-well, selecting a direction (clockwise or counterclockwise) and depositing tokens, one by one, in pathway wells and/or their own home corner-well as they are encountered. As noted above, play continues in this manner until one player has ten tokens in their home corner-well; at that point they are declared the winner of the game.

Figure 3:
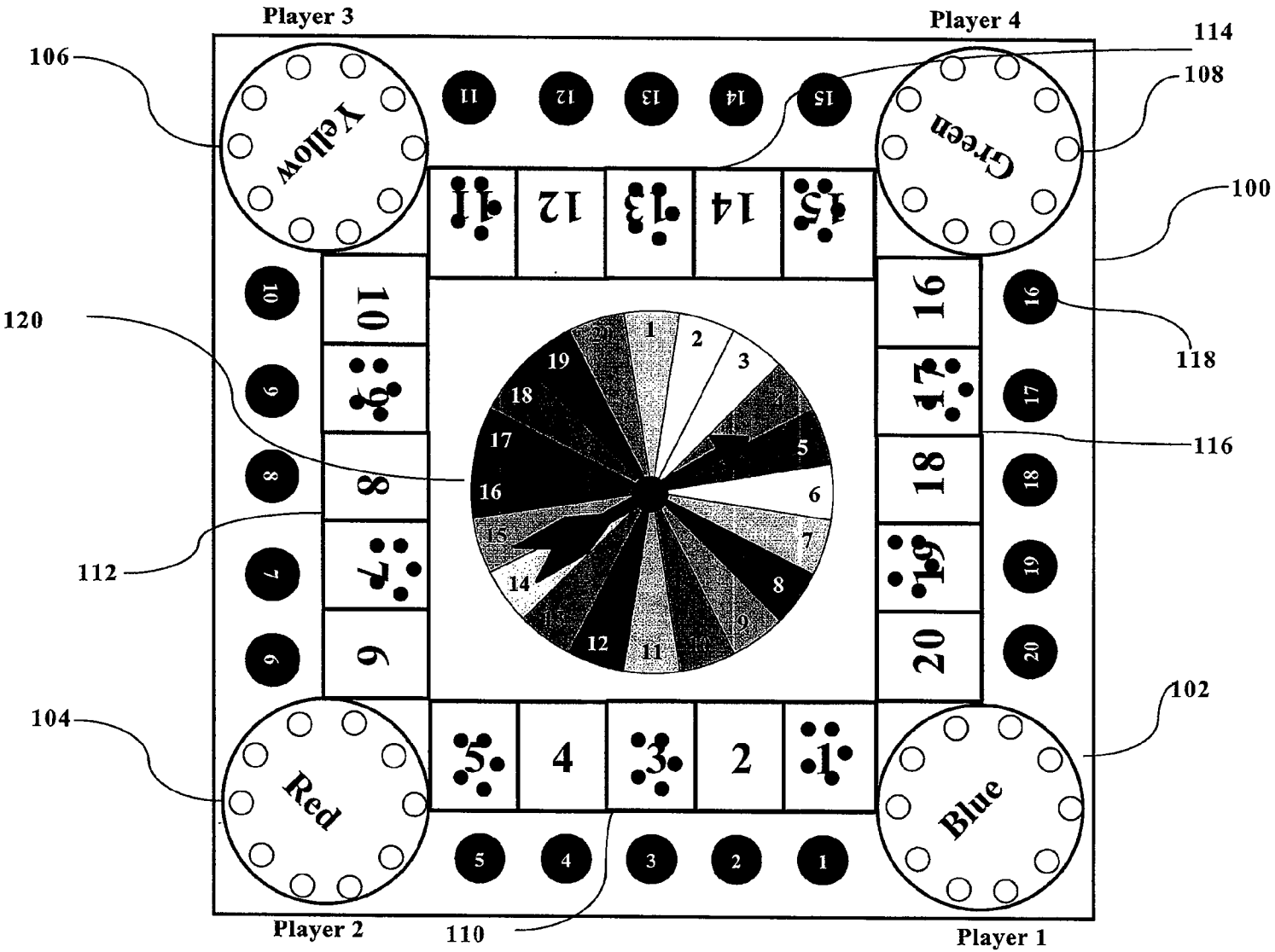
FIGS. 3-7 illustrate a preferred embodiment of the game board of the present invention during use by a field of 4 players, showing the situation on the game board after a series of plays by the 4 players.

FIGS. 3-7 are used to illustrate an example of one full round (Players 1-4) of gameplay in accordance with the present invention. Referring first to FIG. 3, Player 1 is assigned to the blue home corner-well, Player 2 is assigned to the red home corner-well, Player 3 is assigned to the yellow home corner-well, and Player 4 is assigned to the green corner-well. In the example of FIGS. 3-7, the corner wells are shown with the previously-described dimples (the ten circles in each corner well) which serve as a resting place for marbles placed in the corner wells. As described above, the board is set up with five tokens, in this example marbles, in every other pathway well. The marbles appear as smaller black circles in FIG. 3-7. Thus, as can be seen, there are five marbles each in pathway wells 1, 3, 5, 7, 9, 11, 13, 15, 17, and 19. At this point there are no marbles in any of the home corner-wells.

Figure 4:
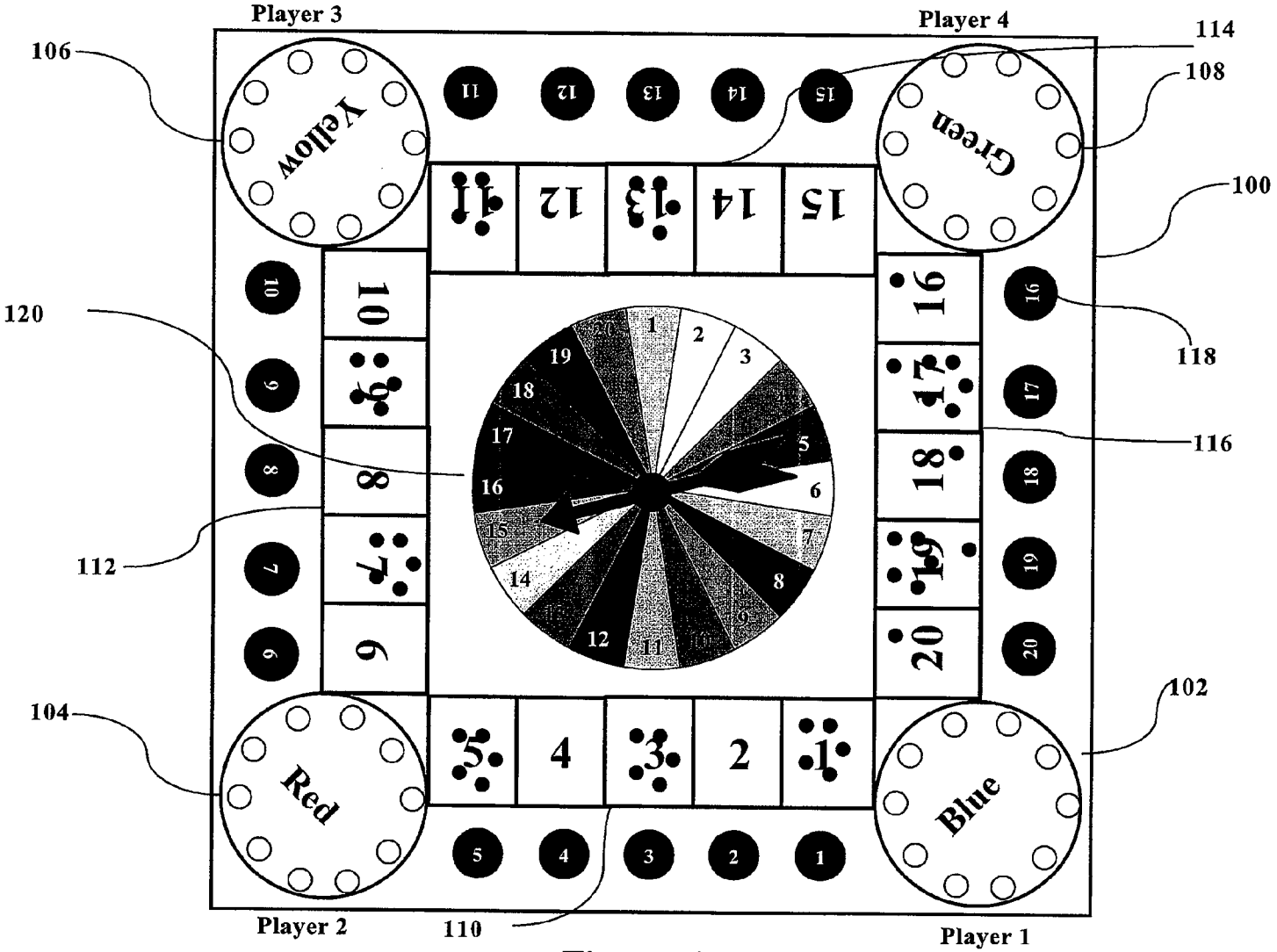

In this example, assume Player 1 has been designated to begin play. Player 1 spins the spin designator and it lands on number 15. Player 1 looks at the board and decides in which direction they will begin to deposit marbles. In this example, assume Player 1 decides to move in a clockwise direction. Player 1 removes the five marbles from pathway well 15 and deposits one each in playing wells 16, 17, 18, 19, and 20. Since pathway well 20, where the last marble is deposited, is empty, Player 1's turn ceases and play moves to Player 2. When this play is finished the pieces on the game board are situated as shown in FIG. 4.

Next, Player 2 spins the spin designator and it lands on number 18. Player 2 picks up all the marbles in pathway well 18 (one marble) and determines which direction to begin depositing marbles. In this example, Player 2 decides to move in a clockwise direction. Strategically, if Player 2 looks ahead, they will note that by moving in the clockwise direction they are going to be able to eventually, as described herein, deposit a marble in their own home corner-well, the red home corner-well. Thus, Player 2 deposits the single marble from pathway well 18 into pathway well 19, resulting in a total of seven marbles in pathway well 19.

Figure 5:
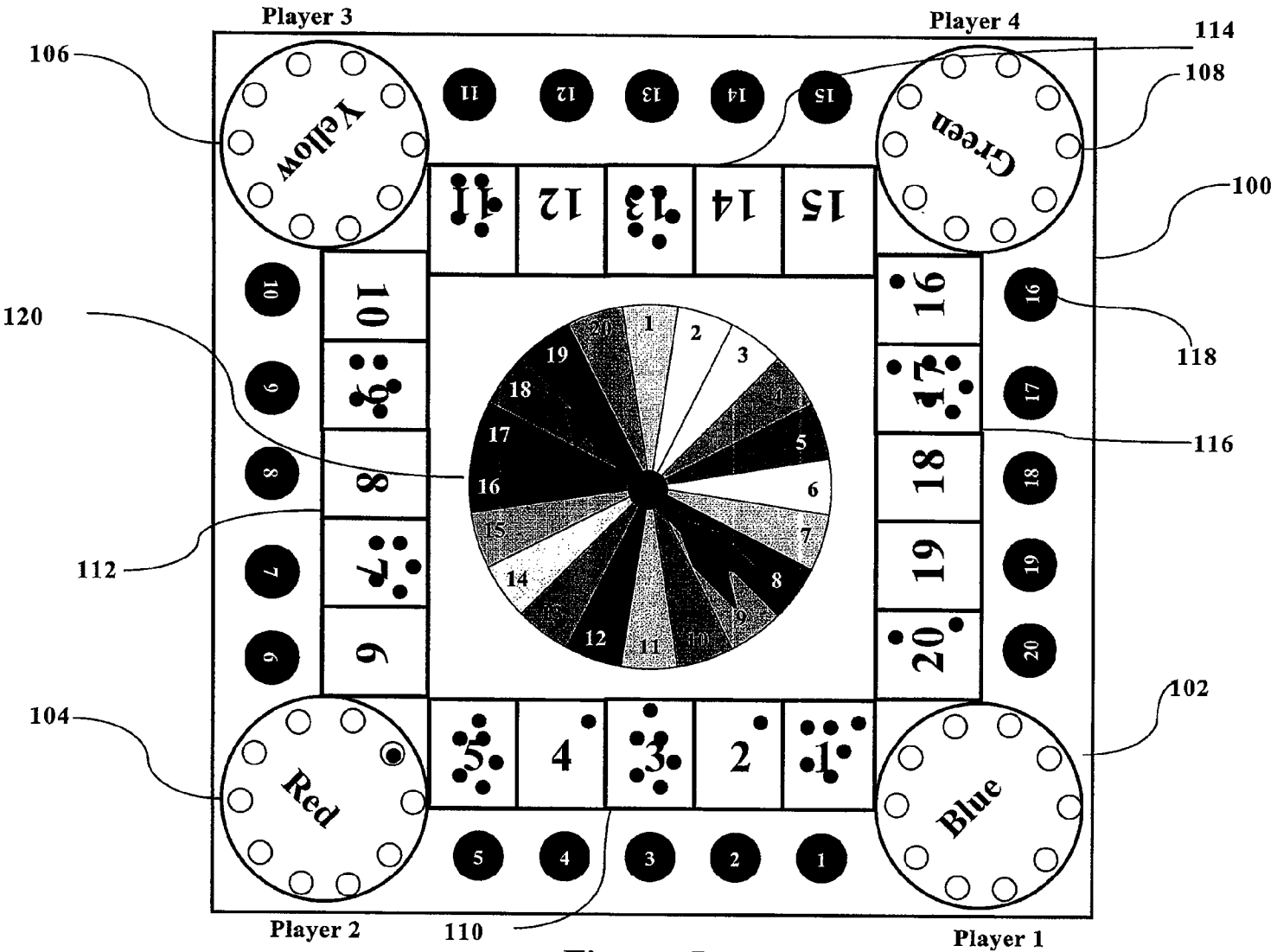

Following the rules of the game, Player 2 then picks up all seven marbles in pathway well 19 and deposits one each in pathway wells 20, 1, 2, 3, 4, 5, and then, since the red home corner-well belongs to Player 2, they are able to place a single marble in red home corner-well 104. At the completion of Player 2's play, the board is situated as shown in FIG. 5.

Figure 6:
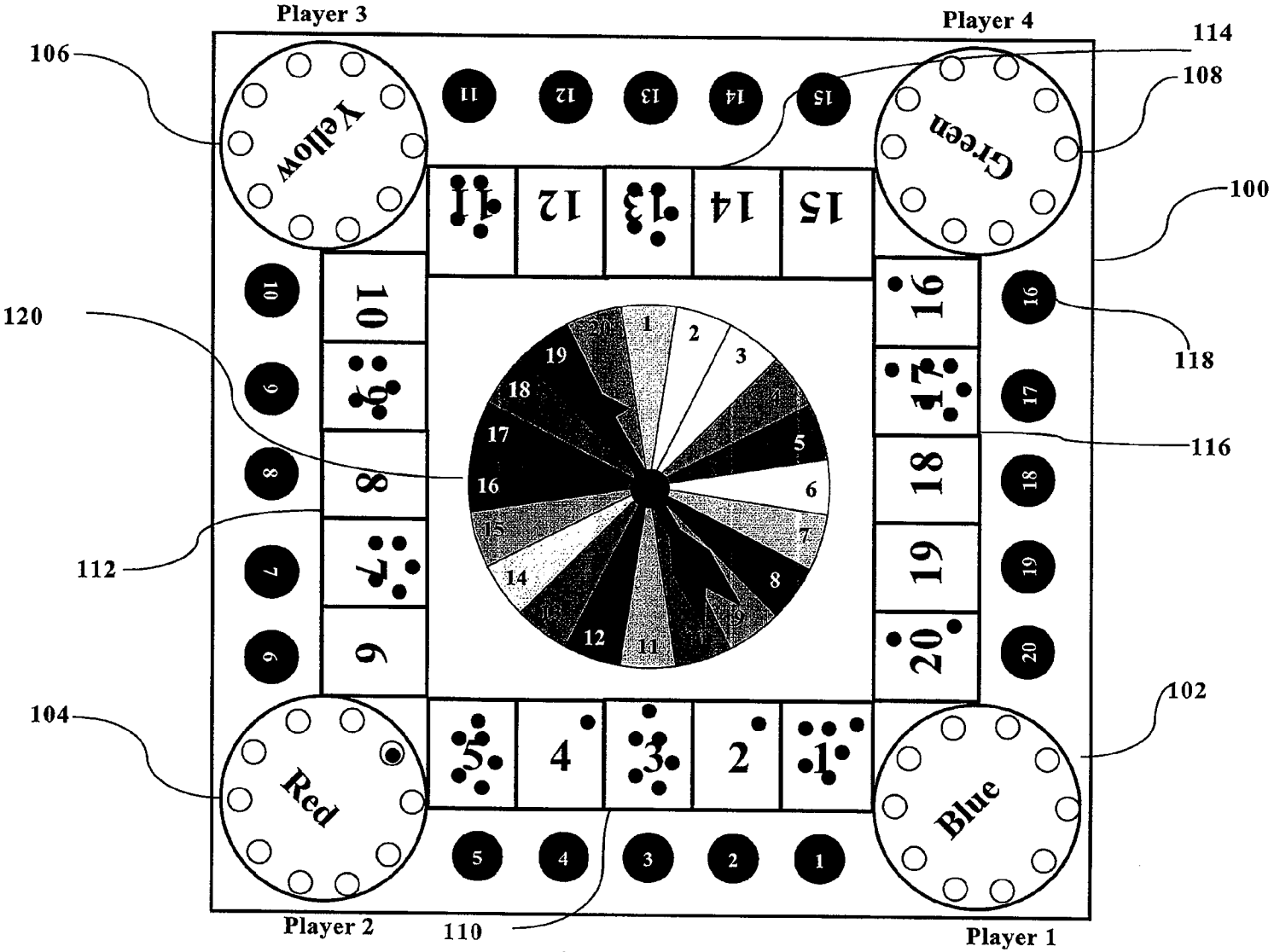

According to the rules of the game, if the player's last marble is dropped in their home corner-well, their play is complete for that turn and play proceeds to the next player, in this example, Player 3. Player 3 spins the spin designator and it lands on number 19. Since there are no marbles in pathway well 19, Player 3's turn is over and the turn proceeds to Player 4. At this point, the board is situated as shown in FIG. 6.

Figure 7:
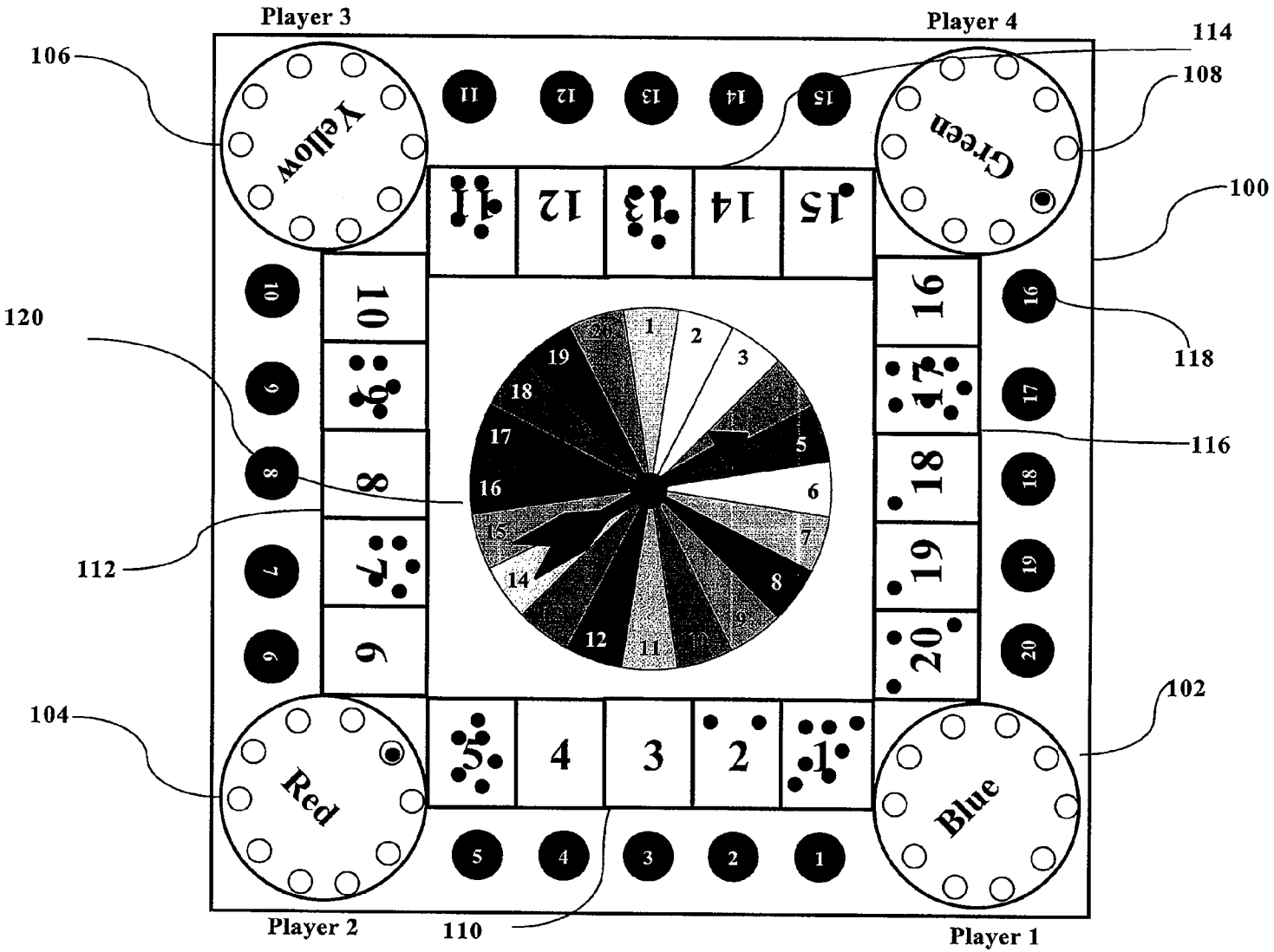

Next, Player 4 spins the spin designator and it lands on number 4. Player 4 picks up all of the marbles in pathway well 4 (one marble) and determines which direction they will move. In this example, Player 4 decides to move in a counterclockwise direction, and deposits the single marble in pathway well 3, bringing the total number of marbles in pathway well 3 up to seven. Player 4 picks up all seven marbles in pathway well 3 and drops them in pathway wells 2, 1, 20, 19, 18, 17, and the last marble in pathway well 16. Since pathway well 16 was not empty, Player 4 picks up the two marbles now in pathway well 16, places one in their home corner-well 108 and the next in pathway well 15. Since pathway well 15 is empty, Player 4's turn is complete. At the completion of Player 4's play, the board is situated as shown in FIG. 7. The process then goes back to Player 1 and continues as described until one player has ten marbles in their own home corner-well.

Numerous variations to the above-described game are contemplated. As noted above, virtually any theme can be used for the game base 202, including educational themes, sports themes, animal themes, and the like. Further, although the game board illustrated in the figures is square, it is understood that the pathways can be rounded and/or other shapes can be used and still fall within the claimed invention.

Although the game base illustrated in FIG. 2A is shown as having the spin designator fixedly attached thereto, it is contemplated that, if desired, the spin designator can be detachable from the game base, to reduce the cost of creating game bases. In such an event, an upright post can be provided with the game base on which to place the spin designator; other methods of attaching a spin designator to the game base will be apparent to a designer of ordinary skill in the art.

Although the present invention has been described with respect to a specific preferred embodiment thereof, various changes and modifications may be suggested to one skilled in the art and it is intended that the present invention encompass such changes and modifications as fall within the scope of the appended claims.

I claim:

1. A method for playing a strategic board game wherein the game is played by two or more players on a game board having a home location for each player and having a common field of play shared by all players, said field of play including plural pathway locations situated between said home locations, and further having multiple game pieces positionable within said home locations and said pathway locations, and further including a move designator activated by each player, in turn, to identify a starting point within said common field of play for beginning a move, said method comprising the steps of:

positioning said multiple game pieces within said common field of play;

allowing each player to be an active player when it is their turn to play;

having the active player activate the move designator to identify a starting point for a move to begin a turn;

having the active player observe said starting point to determine a quantity of said game pieces located at said starting point;

if there are no game pieces located at said starting point, terminating the active player's turn and allowing a next player to begin their turn as the active player;

if there are game pieces located at said starting point, having the active player select a direction for movement and then, one by one, beginning with a pathway location adjacent to said starting point in the selected direction of play, placing said game pieces in successive pathway locations until said game pieces being deposited are depleted;

if the last of said game pieces removed from the starting point is deposited in a pathway location that was empty at the time of deposit, terminating the active player's turn;

if the last of the game pieces removed from the starting point is deposited in a pathway location containing game pieces at the time of the deposit, having the active player pick up said game pieces and continue to deposit said game pieces, one by one, in the pathway locations in the selected direction;

if said active player's home location is encountered along the path of deposit, having the active player place a game piece in said active player's home location;

if a non-active player's home location is encountered along the path of deposit, having the active player skip over the non-active player's home location;

if a last of the game pieces being deposited is deposited in the active player's home location, terminating the active player's turn.

* * * * *